United States Patent [19]

Stefano et al.

[11] 4,304,166

[45] Dec. 8, 1981

[54] ROTATABLE MUSICAL INSTRUMENT STAND

[75] Inventors: Joseph R. Stefano, Oreland; Norman Rosenzweig; Carl D. Homan, Jr., both of Philadelphia, all of Pa.

[73] Assignee: East Wind Industries, Inc., Dover, Del.

[21] Appl. No.: 92,001

[22] Filed: Nov. 19, 1979

Related U.S. Application Data

[63] Continuation-in-part of Ser. No. 966,138, Dec. 4, 1979, abandoned.

[51] Int. Cl.[3] ..... G10D 9/00

[52] U.S. Cl. ..... 84/385 A; 84/453

[58] Field of Search ..... 84/327, 385 B, 387 A, 84/453; 211/77, 78, 163

[56] References Cited

U.S. PATENT DOCUMENTS

| | | | |
|---|---|---|---|
| 2,600,922 | 6/1952 | Rodolfa | 211/78 X |
| 3,478,890 | 11/1969 | Allsop | 211/163 |
| 4,145,950 | 3/1979 | Glantz | 84/385 B |
| 4,161,131 | 7/1979 | Blayman | 84/453 |

*Primary Examiner*—Lawrence R. Franklin

*Attorney, Agent, or Firm*—Frederick A. Zoda; John J. Kane; Albert Sperry

[57] ABSTRACT

A stand for woodwind musical instruments features an annular base member, an annular revolvable support member, bearing means rotatably supporting the support member on the base member, and a plurality of musical instrument support pegs vertically mounted on the support member and arranged in a circle having a center coincident with the axis of rotation of the support member and preferably positioned closer to the axis of rotation than the bearing means, some, at least, of the pegs being configured at the base and top portions thereof to conform, respectively, to the shape of the bell and the bore of the instrument supported thereby.

28 Claims, 7 Drawing Figures

ROTATABLE MUSICAL INSTRUMENT STAND

BACKGROUND OF THE INVENTION

1. Field of the Invention

The present invention relates to rotatable stands for holding musical instruments.

2. Description of the Prior Art

Musicians who play woodwind instruments in a crowded area such as a night club or in an orchestra pit in a theater, frequently play a number of instruments such as a clarinet, an oboe, a saxophone, the English horn, a flute, an alto flute, and a piccolo. This has presented a problem as to how to dispose the several instruments alongside the musician for ready access. While stands have been provided for holding the instruments in position to be picked up and played by the musician one after another as dictated by the score of the musical composition being performed, the previous stands have not been convenient to use, nor have they been safe. With such stands it is easy to knock the instruments off the stands in a crowded, tight, often dark area, such as an orchestra pit. Specifically, in moving from one musical instrument to another during a performance, a musician has had to reach over the instruments on the stand in returning to the stand the instrument that has just been played and also in picking up the instrument that is to be played next. This has required the musician to exercise great care to avoid knocking down all of the instruments and damaging them.

Proposals made in the prior art for holding musical instruments are disclosed in the following U.S. patents:

- U.S. Pat. No. 1,888,927—A. S. Lang—Issued Nov. 22, 1932
- U.S. Pat. No. 1,900,718—A. S. Lang—Issued Mar. 7, 1932
- U.S. Pat. No. 2,559,739—S. H. Sherman—Issued July 10, 1951
- U.S. Pat. No. 3,203,298—J. N. Sumrall—Issued Aug. 31, 1965
- U.S. Pat. No. 4,036,462—E. A. Sheftel—Issued July 19, 1977
- U.S. Pat. No. 4,145,950—F. Glantz—Issued Mar. 27, 1979

The Lang patents disclose a combined carrying case and holder for musical instruments, the holder accommodating but two instruments, a saxophone and a clarinet. Similarly, the Sumrall patent discloses a combined carrying case and holder, the holder accommodating but two clarinets although storage space for several reeds is also provided. The holder of the Sherman patent is for musical instrument accessories such as horn mutes and maracas and comprises several wire arms and loops, the holder being attachable to the post of a music rack. The Sheftel patent shows a rack for holding a plurality of musical instruments and the Glantz patent discloses another non-rotatable rack with the individual instruments arranged in a circle.

Thus, there exists a need for a musical instrument stand that will accommodate a number of different woodwind musical instruments that are played by musicians, a stand that is more convenient for use by musicians as they move quickly from one instrument to another during a performance, and that supports the instruments in stable manner while preventing damaging thereof.

SUMMARY OF THE INVENTION

An object of the invention is to provide an improved stand for holding a plurality of musical woodwind instruments, each in easily adjustable, convenient and readily accessible position, thereby facilitating the replacement of an instrument that has been in use and the selection and picking up of the instrument next to be played, without placing any of the instruments in jeopardy of being knocked over.

Another object of the invention is to provide a revolvable stand for holding musical instruments that has especial utility in a crowded, dark or tight area such as in a night club or in a theater orchestra pit.

In accomplishing the foregoing objects and other objectives of the invention, there is provided a stand for holding woodwind instruments comprising an annular or ringshaped base member, a revolvable musical instrument support member, a lazy Susan bearing means supporting the support member on the base member, a number of upwardly extending musical instrument support pegs or projections mounted on the support member including a soprano saxophone peg, a clarinet peg, an oboe peg, a combination alto flue and piccolo peg, and a combination flute and piccolo peg, the pegs being located on a circle having a center coincident with that of the axis of rotation of the support member on the base member and spaced inwardly toward the axis with respect to the bearing means and being suitably attached to the support member, some, at least, of said pegs being configured at the base and top portions thereof to conform, respectively to the shape of the bell and the bore of the instruments supported thereby. Each of the pegs preferably including a luminescent means on the top tips thereof to facilitate location of the pegs in dimly lighted areas. A musical instrument stand so structured is stable and revolvable and the several musical intruments are firmly held on the associated pegs, being adapted, however, for easy removal therefrom. Each peg preferably including a cushioning means located between the peg and the support members to provide some downward cushioning of the individual pegs to minimize damaging of the instruments during placement thereof. Alternatively, the cushioning means can extend laterally outside of the supporting peg over the support member to prevent direct contact between the support member and the instrument itself. With this configuration as one musical instrument is replaced on the stand, another instrument is adapted quickly to be brought into position to be picked up simply by revolving the musical instrument support member thereby avoiding the need for reaching over several instruments and placing them all in jeopardy of being knocked down and damaged.

DESCRIPTION OF THE PREFERRED EMBODIMENTS

Figure 1:
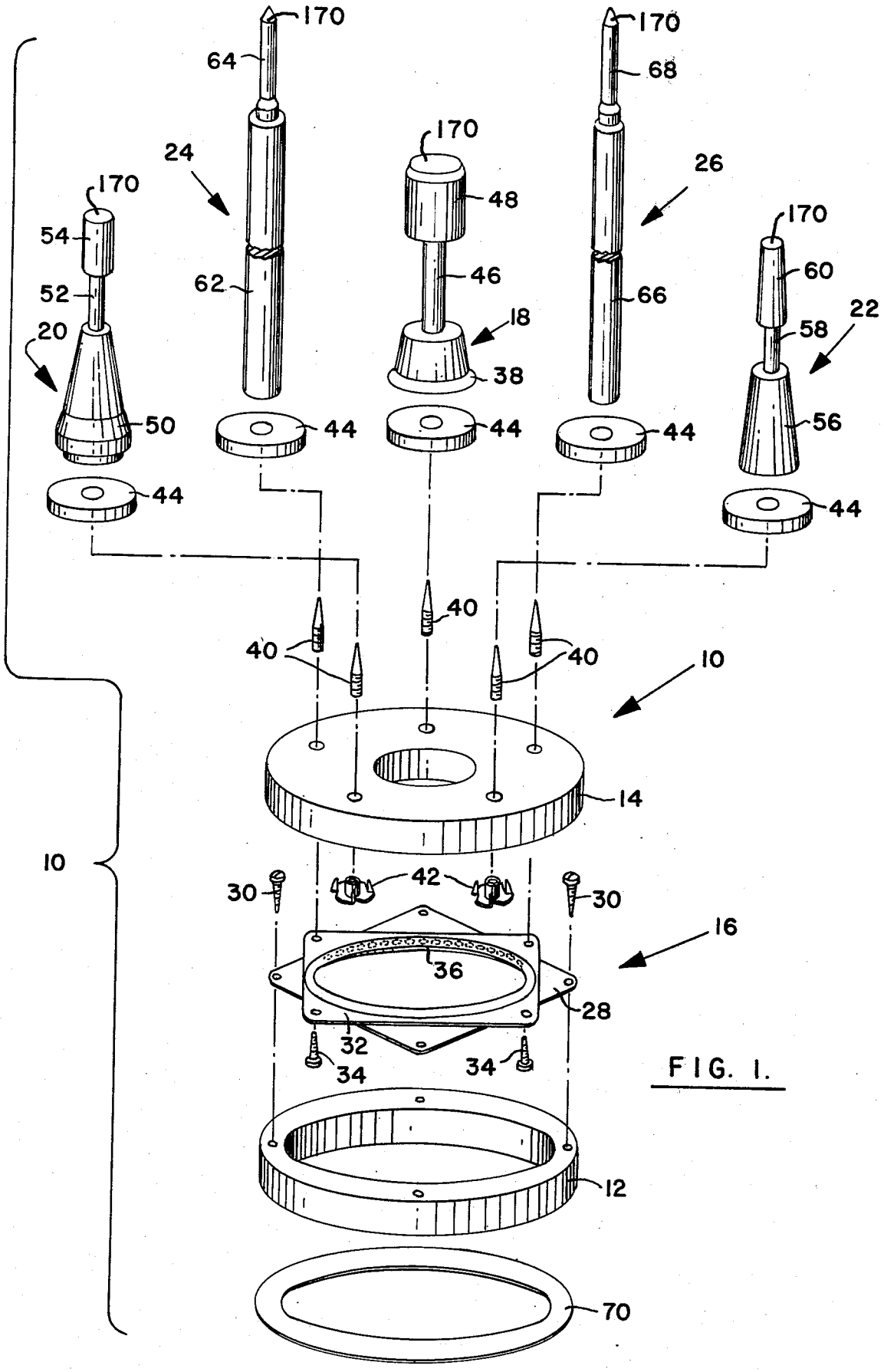
FIG. 1 is an exploded perspective view of the first embodiment of the improved rotatable musical instrument stand according to the invention.

As illustrated in FIG. 1, the rotatable musical instrument stand, designated by the reference numeral 10, includes an annular or ring-shaped base member 12, a revolvable support member 14, a lazy Susan bearing 16 that revolvably supports the support member 14 on the base member 12, and a number of vertically extending musical instrument support pegs or projections indicated at 18, 20, 22, 24, and 26 that are mounted on support member 14.

The lazy Susan bearing 16 may be of a known type and includes a first rectangular plate 28 that is attached at each corner by a wood screw 30 to the base member 12. The bearing 16 includes a second rectangular plate 32 that is attached at each corner by a wood screw 34 to the support member 14, the spacing of the screws 34 from the axis of rotation of member 14 and bearing 16 being such as to allow access from underneath ring-shaped base member 12 to the screws 34, adjacent the inner periphery thereof. A ball bearing race 36 joins the plates 28 and 32 and provides for relative rotation movement between plates 28 and 32 whereby support member 14 is revolvably supported on base member 12.

The musical instrument support pegs or projections, as shown in the drawings, include a soprano saxophone peg 18, a clarinet peg 20, an oboe peg 22, a combination alto flute and piccolo peg 24, and a combination flute and piccolo peg 26.

The soprano saxophone peg 18 includes a base 38 having an inverted truncated cone shape and chamfered at the upper edge. Base 38 is detachably connected to support member 14 by a hanger bolt 40 and a nut 42, nut 42 being recessed in the bottom of support member 14 to avoid physical interference with the lazy Susan bearing 16 and the base member 12. Desirably, as shown, a resilient circular cushion or disc indicated at 44 is provided between base 38 and support member 14. Disc 44 provides an amount of downward cushioning for the entire configuration of peg 18 such that as the instrument is placed downwardly thereon the disc will absorb substantially all of the impact between the instrument itself and the peg 18. Also, if the instrument is not placed directly downwardly in proper collimation with the peg, a slight lateral flexing is made possible by the cushion 44 to facilitate proper alignment with the instruments. Furthermore, cushion 44 may extend slightly further outwardly such that if the instrument extends all the way downwardly such as it would normally rest upon the upper surface of support member 14 the cushion will provide a soft area of abutment between the instrument and the support member 14. Peg 18 further includes a stem 46 that extends upwardly from base 38. Stem 46 is provided at the top with a bulb 48 for protecting the inside or bore of the soprano saxophone against abrasion, and for minimizing any tendency for the instrument to stick when being quickly removed in preparation for playing. To these ends, the bulb 48 is tapered to conform with the inside or bore of the instrument, being chamfered at the upper edge. To facilitate the location of the peg 18 in the dark for the replacement of a soprano saxophone thereon the top surface of bulb 48 may include a fluorescent edge 170. In this manner in darkly lighted orchestra pit and similar environments easy location of the proper peg 18 is facilitated.

The clarinet peg 20 includes a base 50 that has an inverted truncated cone shape and is detachably connected through a cushion 44 to support member 14 by a hanger bolt 40 and a recessed nut 42. A stem 52 extends upwardly from base 50 and is provided at the top thereof with an instrument support bulb 54 to protect the inside or bore of the clarinet from abrasion and to avoid sticking. Cushion 44 operates in the similar fashion as described above with respect to peg 18 for clarinet peg 20 and all of the other types described hereunder. The size and shape of bulb 54 is such as to conform with the inside or bore of the instrument for a snug fit.

The oboe peg 22 includes a base 56 that has an inverted truncated cone shaped base and is detachable connected through a cushion 44 to support member by a hanger bolt 40 and a recessed nut 42. A stem 58 extends upwardly from base 56. At the stop of stem 58 there is provided an instrument support bulb 60 to protect the inside or bore of the oboe from abrasion and to avoid sticking. Bulb 60 is shaped to conform to the inside or bore of the instrument for a snug fit.

It will be understood that, if desired, the base 50 of the clarinet peg 20 may be modified to accommodate an oboe as well as a clarinet.

The combination alto flute and piccolo peg 24 includes a stem 62, shown broken for convenience of illustration, that is detachably connected through a cushion 44 to the support member 14 by a hanger bolt 40 and a recessed nut 42. Stem 62 extends upwardly from the support member 14, the cushion 44 more specifically protecting the foot joint of the alto flute against damage with the stem centering and holding the flute in proper position. A smaller stem 64 desirably is provided at the top of stem 62, being integral therewith, for accommodating a piccolo. Peg 24 as well as all of the pegs described herein may preferably include the fluorescent tip 170 at the uppermost edge thereof to facilitate identification in dimly lighted areas as described with respect to peg 18.

The combination flute and piccolo peg 26 includes a stem 66, shown broken, that is detachably connected through a cushion 44 to the support member 14 by a hanger bolt 40 and a recessed nut 42. The cushion protects the foot joint of the flute against damage with the stem 66 centering and holding the flute in proper position. To that end, the fit of the stem 66 with the bore of the flute is fairly snug but is such as to facilitate easy removal of the flute from the stem 66. A smaller stem 68 desirably also is provided at the top of the stem 68 to accommodate a piccolo.

It is noted that when a piccolo is supported on stem 68 or on stem 64, the associated stem 66 and 62 is unavailable for supporting a flute or alto flute, respectively. That is to say, two instruments may not be supported on the same peg at the same time.

While not illustrated, it will be understood that in accordance with the invention, there may also be provided on the support member 14 a peg to support an English horn comprising a base having a modified inverted truncated cone shape, detachably connected through a cushion 44 to the base 14 by a hanger bolt 40 and a recessed nut 42, and provided with a stem extending upwardly from the base and having a bulb at the top thereof conforming with the inside or bore of the English horn. Additionally, a shoulder may be formed about half way up the English horn peg base and a resilient ring may be mounted on the shoulder to resiliently support the bell of the English horn.

By way of illustration and not limitation, it is noted that the several components of the musical instrument stand according to the present invention, in a preferred embodiment thereof, have the following dimensions:

| Component | Thickness | External Diameter | Internal Diameter |
|---|---|---|---|
| Base Member 12 | $\frac{7}{8}$" (2.2 cm) | $8\frac{5}{8}$" (21.9 cm) | $7\frac{3}{8}$" (18.9 cm) |
| Support Member 14 | $\frac{3}{4}$" (1.90 cm) | $8\frac{1}{2}$" (21.6 cm) | $2\frac{1}{2}$" (6.35 cm) |
| Cushion 44 | 5/16" (0.79 cm) | $2\frac{3}{8}$" (6.03 cm) | |

| Component | Greatest Diameter | Height |
|---|---|---|
| Base 38 | $2\frac{3}{8}$" (6.03 cm) | 1 13/16" (4.60 cm) |
| Base 50 | $1\frac{7}{8}$" (4.74 cm) | $3\frac{3}{8}$" (8.37 cm) |
| Base 56 | $1\frac{3}{8}$" (3.49 cm) | 2 9/16" (6.51 cm) |
| Stem 66 | $\frac{1}{2}$" (1.27 cm) | $2\frac{7}{8}$" (7.30 cm) |
| Stem 46 | 7/16" (1.11 cm) | $2\frac{1}{2}$" (6.35 cm) |
| Stem 52 | 1/14" (0.64 cm) | $1\frac{7}{8}$" (4.74 cm) |
| Stem 58 | $\frac{1}{4}$" (0.64 cm) | $1\frac{1}{4}$" (3.17 cm) |
| Stem 62 | 1" (2.54 cm) | $11\frac{1}{4}$" (28.57 cm) |
| Stem 68 | 11/16" (1.74 cm) | $11\frac{3}{4}$" (29.83 cm) |

The hanger bolts 40 are 5/17" (0.79 cm) long and have 18 threads to the inch. Nuts 42 may be of the so-called "Tee-Nut" variety. Resilient cushion or disc 44 is $\frac{1}{4}$" (0.635 cm) thick and 2 $\frac{1}{2}$" (6.35 cm) in diameter, and is made of rubber or equivalent material. Preferably the radial distance from the axis of rotation of support member 14 to the bearing of bearing means 16 is greater than the radial distance from the axis of rotation of the support member 14 to the axes of the individual support pegs 18, 20, 22, 24 and 26. In this manner a more stable structure is provided by supporting the entire weight of the instruments internally of the supporting surface of bearing means 16.

Figure 2:
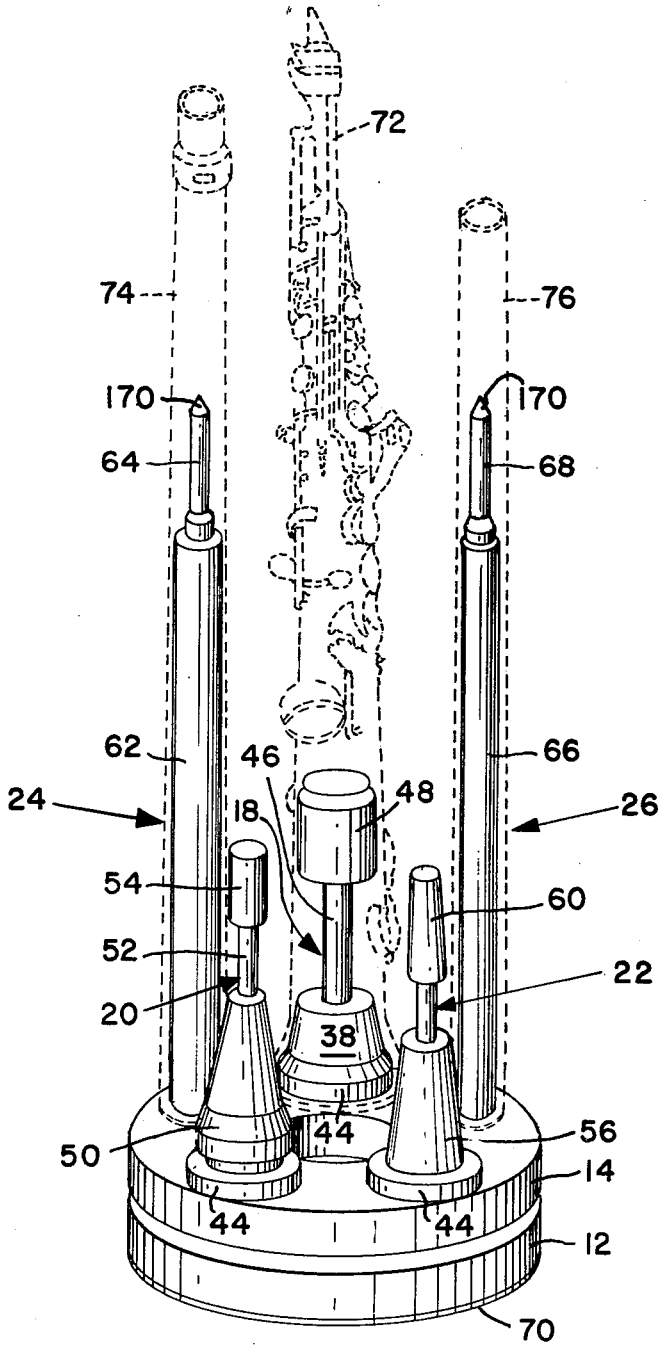
FIG. 2 is an assembled perspective view of the stand of FIG. 1 and schematically illustrates the manner in which musical instruments are supported thereby.

For the purpose of illustrating the use of the musical instrument stand, in the assembled perspective view of FIG. 2, a soprano saxophone 72, an alto flute 74 and a flute 76 are indicated in dotted lines as being supported on a respectively associated instrument support peg 18, 24 and 26. It is contemplated that the bell of the soprano saxophone and the open ends of the alto flute and the flute rest on the surface of the support member 14 or upon the cushion means 44 associated therewith.

With the bottom of the bell of the soprano saxophone 72, the open ends of the alto flute 74, and flute 76 and the bells of a clarinet and an oboe resting on the surface of the support member 14 and not on the cushion 44 and not on the associated peg, the described structure for a musical instrument stand, according to the present invention, provides a stable platform for the instruments. In the preferred embodiment of the invention, as shown, the support member 14 provides a three inch span between the inner and outer peripheries thereof. The holes for the hanger bolts 40 are positioned midway between the inner and outer peripheries of support member 14, the distance of 1 $\frac{1}{2}$" to the inner and outer peripheries of member 14, assuring that there is no overlap of the inner and outer peripheries by the instrument bells. The holes for the hanger bolts 40 are uniformly spaced on a circle having the axis of rotation of support member 14 and bearing 16 at its center.

A suitable material for the base member 12, support member 14 and the several pegs and their associated components (except cushion 44) is hard wood, It will be understood, however, that these components may be made of other materials, if desires such as plastic or lightweight metal. When made of hard wood, particularly with the members 12 and 14 in annular or ring form, as described, the musical instrument stand is heavy enough to provide a stable support for the several musical instruments without being so heavy as to make it difficult for a musician conveniently to handle.

It will further be understood that the bases of the several pegs may be covered with cork or other material so as to be of proper size and to be non-slip, such as teflon or felt or the like. Also, the bulbs 48, 54 and 60 may be provided with a covering of cork, if desired, to provide further protection for the bore of the musical instruments and to assure easy removal of the instruments from the pegs.

Desirably, a layer of felt such as indicated at 70 is provided on the bottom of base member 12 to prevent sliding of the musical instrument stand on the surface of the hard wood or other floor on which the stand is placed when in use.

Figure 3:
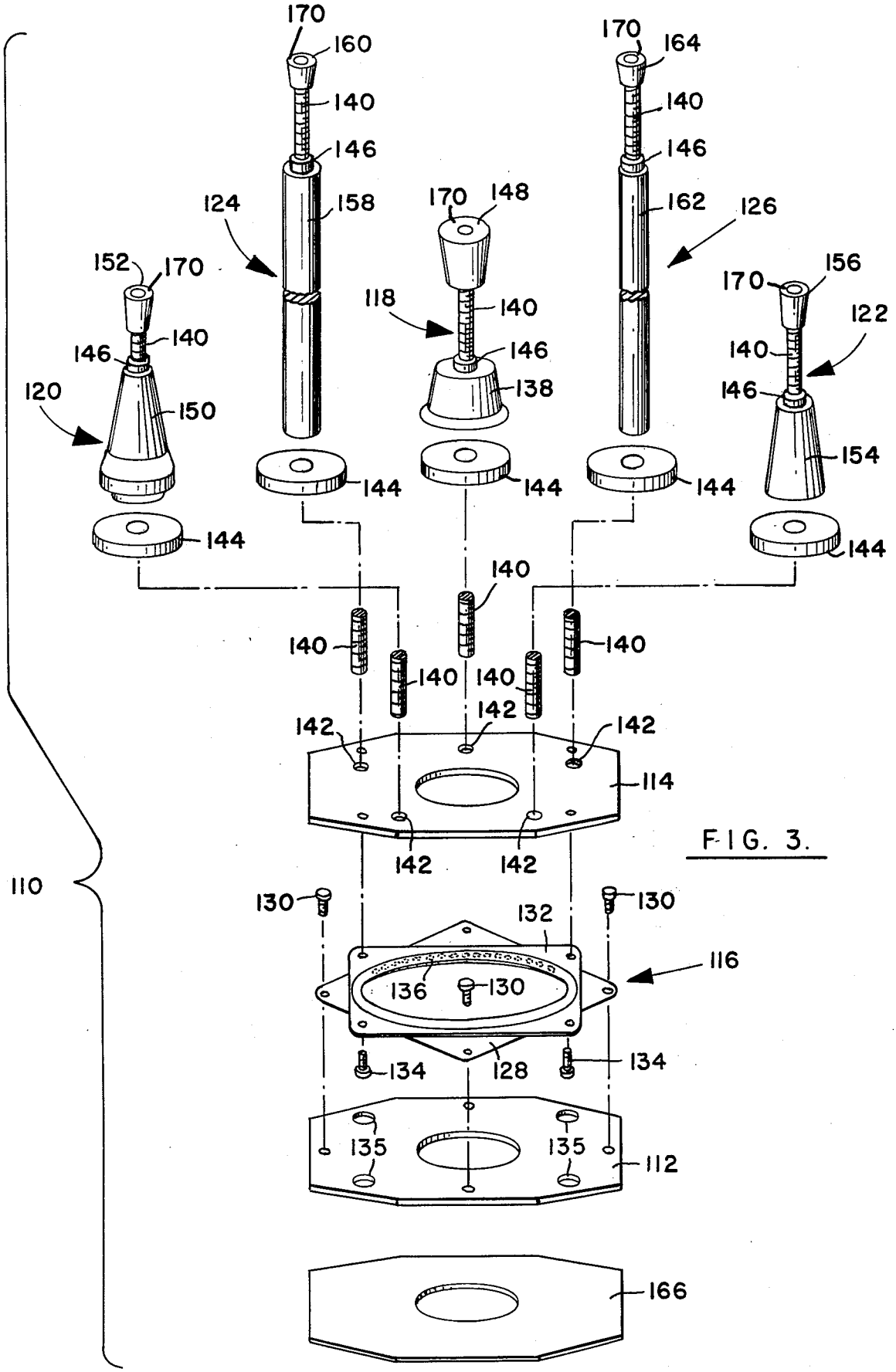
FIG. 3 is an exploded perspective view of a second and preferred embodiment of the stand according to the invention that has a low center of gravity.
Figure 4:
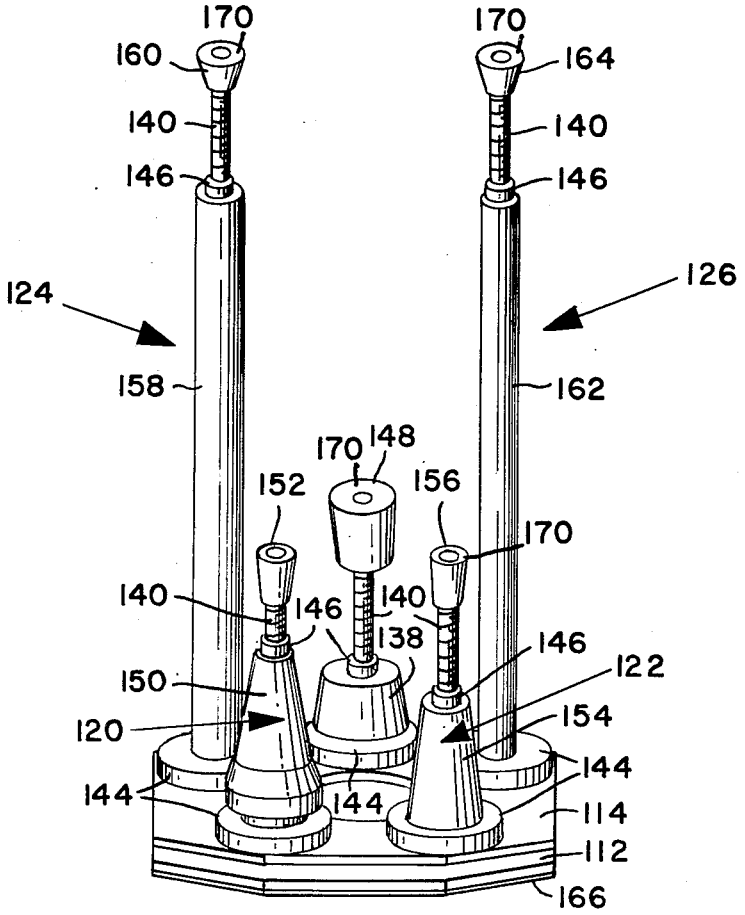
FIG. 4 is an assembled perspective view of the stand shown in FIG. 3.

In the preferred embodiment of the musical instrument stand 110 that is illustrated in FIGS. 3 and 4, the base plate and support plate, indicated at 112 and 114, respectively, are made of metal, specifically steel plate having eight sides and desirably one-eighth inch (0.05 cm) thick. The stand 110 further includes a lazy Susan bearing 116 that revolvably supports the support member 114 on the base member 112, and a member of vertically extending musical instrument support pegs indicated at 118, 120, 122, 124 and 126 that are mounted on support member 114.

The lazy Susan bearing 116 may be similar to the bearing 16 of the apparatus embodiment of FIGS. 1 and 2, and includes a first rectangular metal plate 128 that is attached by a metal screw 130 at each corner to the metal base plate 112. The bearing 116 further includes a second rectangular plate 132 that is attached by a metal screw 134 at each corner to the metal support member 114, suitably placed holes 135 being provided in the base member 112 to allow access to the screws 134 from beneath the base member 112. A ball bearing race 136 in bearing 116 joins the plates 128 and 132 and provides for relative movement between support plate 114 and base member 112.

The musical instrument support pegs provided comprise a soprano saxophone peg 118, a clarinet peg 120, an oboe peg 122, a combination alto flute and piccolo peg 124, and a combination flute and piccolo peg 126. Material suitable for the several pegs is hardwood although other materials such as plastic or metal may be used, if desired.

The shapes of the base members of the several pegs may be the same as in the invention embodiment previously described. The manner of detachable attachment of the pegs to the support member 114 is different, however, elongated threaded studs indicated at 140 being provided for the purpose. Thus, as shown in FIG. 3, the saxophone peg 118 includes a base 138 that is connected to the support plate 114 by such a threaded stud 140. Stud 140 is threaded at one end into a tapped hole 142 provided in support plate 114, a resilient circular cushion or disc 144 being provided between base 138 and support plate 114 to provide some downwward cushioning to pegs 118, 120, 122, 124 and 126 when the instruments are placed thereon. Stud 140 extends upwardly through and beyond base 138 and is provided with a lock collar 146 for holding base 138 firmly in place on support plate 14. At the top of stud 140 there is provided a resilient rubber stopper 48 having the shape of an inverted truncated cone. Stopper 148 is selected to fit the bore of the instrument in an upper region thereof and is provided for the purpose of guiding the instrument and protecting the bore of the instrument against abrasion. Each of the pegs 118, 120, 122, 124 and 126 may preferably include a fluorescent or other luminescent tip area 170 to facilitate placement of the instruments back on to the associated peg in dimly lit environments.

The clarinet peg 120 includes a base 150 that is detachably connected through a cushion 144 to the support plate 114 by a threaded stud 140. Thus, stud 140 is threaded into an associated tapped opening 142 that is provided in support plate 114, and extends upwardly through base 150. A lock collar 146 is provided on stud 140 to hold the base 150 firmly in place on the support plate 114. A rubber stopper, 152, having the shape of an inverted truncated cone is provided at the top of stud 140, being selected to fit the bore of the clarinet and protect the inside or bore thereof from abrasion.

The oboe peg 122 includes a base 154 that is detachably connected through a cushion 144 to support plate 114 by a threaded stud 140. Stud 140 is received at one end in a tapped hole 142 in plate 114 and is provided wih a lock collar 146 for holding base 154 in place on plate 114. Stud 140 extends upwardly from base 154 and is further provided at its upper end with a rubber stopper 156 having the shape of an inverted truncated cone. Stopper 155 is fitted to the bore of the oboe to protect the bore from abrasion.

The combination alto flute and piccolo peg 124 includes a stem 158, shown broken, that is detachably connected through a cushion 144 to the support plate 114 by a threaded stud 140 received in an associated tapped hole 142, a lock collar 146 being provided to hold stem 154 in place. Threaded stud 140 extends upwardly from stem 158 and is provided at its upper end with a rubber stopper 160 having the shape of an inverted truncated cone. The size of stopper 160 is selected to fit the bore of the alto flute so as to protect the bore of an alto flute against abrasion, and also to accommodate a piccolo.

The combination flute and piccolo peg 126 includes a stem 162, shown broken, that is detachably connected through a cushion 144 to the support member 114 by a threaded stud 140. Stud 140 is received in a tapped hole 142 in support plate 114 and is provided with a lock collar 146 for holding stem 162 in place, an inverted truncated cone rubber stopper 164 being provided at the upper end thereof. The size of stopper 164 is selected so as to protect the bore of the flute while also accommodating a piccolo.

An advantage stemming from the use of metal for the base plate 112 and support plate 114 for the musical instrument stand is the closeness of the support plate 114 to the floor and the consequent low center of gravity presented by the stand, the center gravity of the stand being so low as substantially to preclude toppling of the stand. Further advantages of the metal stand embodiment are its favorable weight and manufacturing cost, both of which are less than for the stand of FIGS. 1 and 2 that utilizes wood for the base 12 and support member 14.

With respect to ease of manufacture, the metal stand embodiment of FIGS. 3 and 4 is also preferred because it lends itself to manufacture at a faster rate.

While the base 112 and support plate 114 are shown as having eight sides, these components may be made square or circular, if desired. It is noted, however, that rounding the steel base tends to add to the manufacturing cost of the stand.

Desirably, the diameter of the threaded studs 140 may be one-fourth if an inch (0.635 cm), the number of threads per inch being 20.

It is contemplated that the height of the threaded studs 140 for the several pegs may be varied, as desired, to accommodate desired musical instruments for mounting on the stand, as in the musical instrument stand embodiment of FIGS. 1 and 2. Thus, the length of the threaded studs 140 may be selected, and to a limited extent, the studs 140 may be raised and lowered in the associated peg to effect the optimum height for the particular musical instrument being supported. Such limited adjustment is effected by loosening of the associated lock collar 146 and rotating the threaded stud 140 in the proper direction in the tapped opening 142 in support plate 114. Where the threaded stud 140 and the base member of the associated peg are in threaded engagement, relative rotation of the stud 140 and peg base member also is required for such adjustment.

The tapped holes 142 in the support plate 114 for the threaded studs 140 are uniformly spaced on a circle having the axis of rotation of support plate 114 and bearing 116 at its center.

At each of the pegs 118, 120, 122, 124 and 126, the portion of each of the associated threaded stud 140 that is exposed is relatively short. Thus, there is no need to cover such exposed portions as they are not in position to cause abrasion to the musical instruments supported by the pegs.

It is further contemplated that the rubber stoppers 148, 152, 156, 160 and 164 at the top of the threaded studs 140 may be of the appropriate size to provide a proper fit for the particular instrument to be supported by the associated peg.

As in the embodiment of the FIGS. 1 and 2, a layer of felt, rubber with felt, or plastic, such as that indicated at 166 in FIG. 3, may be provided on the bottom of plate 112, being fastened thereto by a suitable adhesive to prevent sliding of the musical instrument stand on the surface of the hard wood or other floor on which the stand 110 is placed when in use, and also to avoid scratching by the stand of such floor surface.

Figure 5:
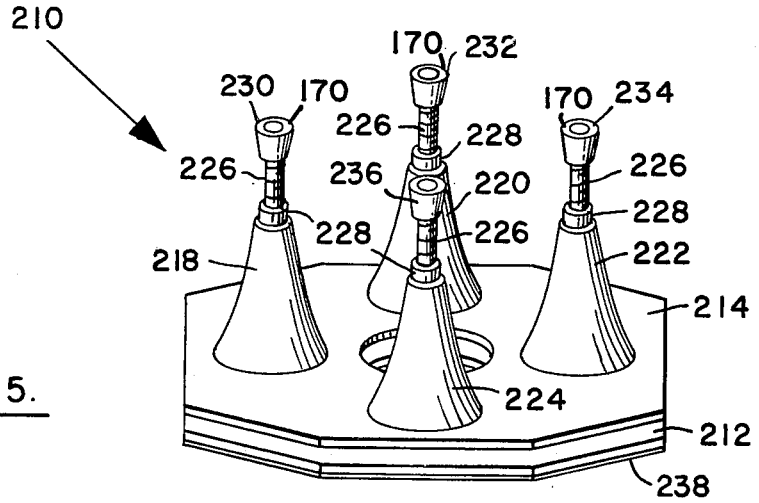
FIG. 5 is an assembled perspective view of a further embodiment of the invention comprising a trumpet stand.

In the perspective view of FIG. 5 there is illustrated a modification of the musical instrument stand of FIGS. 3 and 4 for accommodating four trumpets, specifically a flugel horn, a piccolo or D trumpet, the regular B flat trumpet, and a C trumpet, or any combination of such instruments. Thus there is provided an assembled musical instrument stand 210 comprising a metal base plate 212, a metal support plate 214 and a lazy Susan 216 that are arranged in the same manner described for plates 112, 114 and lazy Susan 116 by reference to FIGS. 3 and 4. There is provided, additionally, in FIG. 5, four pegs 218, 220, 222 and 224 that are supported on the support plate 114, each peg having the proper shape to support the bell of a particular one of the trumpets and preferably including a luminescent tip area 170. It is contemplated that each of the pegs 218, 220, 222 and 224 are retained on the support plate 124 by a threaded stud 226 of suitable length and a suitable associated lock collar 228. At the lower end each of the studs 226 is received by a tapped hole (not shown) in the support plate 214. At the upper end of each of the studs 226 there may be provided an individually associated inverted truncated rubber stopper 230, 232, 234 and 236 for protecting against abrasion the bore of the particular trumpet supported thereby.

Figure 6:
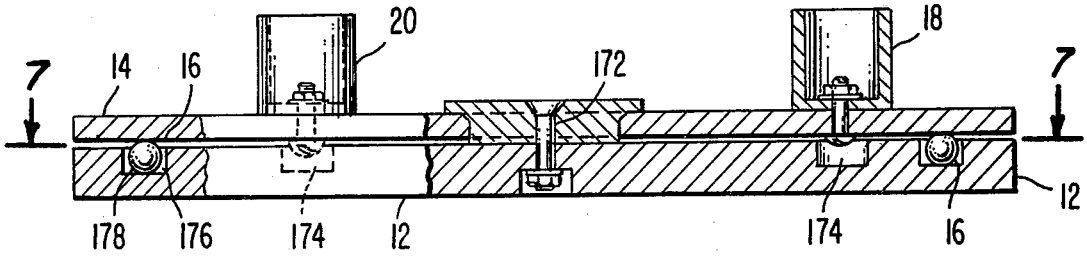
FIG. 6 is a vertical cross-section of the base member and support member configuration of another embodiment of the stand of the present invention.
Figure 7:
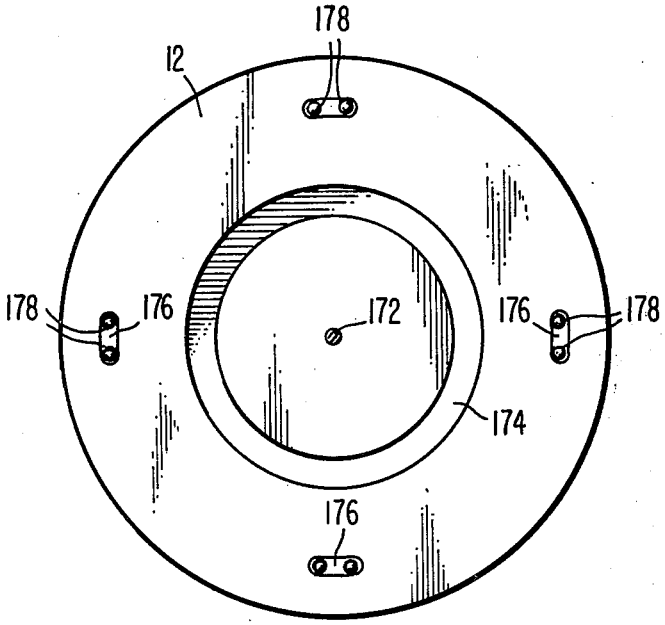
FIG. 7 is a top plan view of the base member of the embodiment shown in FIG. 6.

As in the invention embodiments previously described, the bases of the several pegs may be covered with cork or other materials so as to achieve the proper or optimum size and fit, and also to be non-slip. Additionally, a felt cover 238 may be provided on the bottom of the base 214 to avoid scratching on the surface on which the stand 210 is placed when in use. FIGS. 6 and 7 disclose an alternative embodiment for the present invention wherein a support member 14 is rotatably positioned upon the base member 12 by a mounting bolt 172 vertically oriented coincident with the axis of rotation of the support member 14. With this configuration, it is an important characteristic that the supporting axis of bearing means 16 is located further from the axis of rotation of support member 14 than is the supporting point of pegs 18 and 20 from the axis of rotation. With this configuration the weight supported directly upon support member 14 will not tend to provide an unstable overall configuration since they are located radially inward from the support provided by bearing means 16. Usage of bolts in order to secure the pegs 18 and 20 into location will require possibly the placement of a clearance groove 174 into the upper surface of the base member 12. Also the base member 12 will define in the upper surface thereof as shown in FIG. 7 a plurality of individual slot means 176 adapted to hold a ball means 178 therein to provide the means of rotation of the support member 14 with respect to base member 12.

Therefore, with this alternative configuration a lazy Susan bearing means will not be used and will be replaced by a plurality of slots located in the base member 12 at a location radially outward from the support point of the pegs 18 and 20. As shown in FIG. 7 each slot means 176 will preferably include one or more likely two such ball means 178 to facilitate the bearing support means. This overall configuration the depth of slot means 176 from the upper surface of the base member 12 will be approximately ¼" whereas the size of the individual ball means 178 will preferably be the range of 5/16" inch to thereby provide a separation distance between the upper surface of base member 12 and the lower surface of support member 14 of approximately 1/16" of an inch. In this manner free movement between members 14 and 12 will be facilitated and stability will be enhanced by the locating of the supporting bearing means 16 further from the axis of rotation than the point of support of pegs 18 and 20 for the individual musical instruments.

Thus, there has been provided, according to the present invention, a stand for holding a number of musical woodwind instruments, five as illustrated in two apparatus embodiments, four in another, each in easily adjustable, convenient, and readily accessible position. The stand is stable and revolvable whereby as a musical instrument is returned to the stand another instrument that is desired to play may quickly be brought into position for easy pick up simply by rotating the support member as by grasping an adjacent instrument, thus avoiding the need for reaching over any of the musical instruments and risking knocking them all down.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A rotatable musical instrument stand for woodwind instruments comprising:

(a) a base member;

(b) a rotatable support member;

(c) bearing means supporting said support member for rotation on said base member;

(d) a plurality of cushioning means secured in spaced relation with respect to one another on the upper surface of said support member; and (e) a plurality of upwardly extending musical instrument support pegs mounted upon said cushioning means on the upper surface of said support member to allow lateral and downwward flexing of said support pegs to cushion impact of a musical instrument thereon, access to any of said musical instruments mounted on said pegs being facilitated by rotation of said support member on said base member.

2. A stand as specified in claim 1 wherein each of said musical instrument pegs includes a stem that is detachably connected to said support member and in abutting contact with respect to said cushioning means.

3. A stand as specified in claim 2 wherein each of said resilient cushions is mounted at the base of the associated stem between said stem and said support member, and wherein each of said stem centers and holds the instrument to be supported thereby in proper position, the fit of the stem within the bore of the associated instrument being snug but adapted to easy removal of the instrument from the stem.

4. A stand as specified in claim 2 wherein the stem associated with each of said pegs centers and holds the instrument to be supported thereby in proper position, the fit of the stem within the bore of the instrument being snug but adapted to easy removal of the instrument from the stem.

5. A stand as specified in claim 4 wherein at least some of the stems associated with said pegs include an inverted truncated cone at the base thereof and a bulb at the top thereof configured, respectively, to conform to the shape of the bell and the bore of the instrument to be supported thereby.

6. A stand as specified in claim 1 wherein said bearing means further comprises a plurality of slots defined by said base member and a plurality of ball means positioned within said slots and extending slightly outward therefrom to support said rotatably support member riding thereon.

7. A stand as specified in claim 1 wherein said musical instrument pegs include at least a soprano saxphone peg, a clarinet peg, an oboe peg, a combination alto flute and piccolo peg, and a combination flute an piccolo peg, said pegs being generally uniform spaced from each other on the surface of said support member.

8. A stand as specified in claim 7 wherein all of said pegs are spaced on a circle having the axis of rotation of said support member on said base member at its center.

9. A stand as specified in claim 7 wherein said soprano saxophone peg includes a base that has an inverted truncated cone shape and is detachably connected to said support member.

10. A stand as specified in claim 9 wherein said soprano saxophone peg further includes a stem that extends upwardly from said inverted cone shaped base, and further including a bulb provided at the top of said stem, said bulb being shaped to conform with the inside or bore of the soprano saxophone to be supported thereby.

11. A stand as specified in claim 7 wherein said clarinet peg includes a base having an inverted cone shape and is detachably connected to said support member.

12. A stand as specified in claim 11 wherein said clarinet peg includes a stem that extends upwardly from said inverted cone shaped base, and further including a bulb provided at the top of said stem, said bulb being shaped to conform to the inside or bore of the clarinet to be supported thereby.

13. A stand as specified in claim 7 wherein said oboe peg includes a base that has an inverted cone shaped and is detachably connected to said support member.

14. A stand as specified in claim 13 wherein said oboe peg includes a stem that extends upwardly from said inverted cone shaped base, and further including a bulb provided at the top of said stem, said bulb being shaped to conform with the inside or bore of the musical instrument to be supported thereby.

15. A stand as specified in claim 14 wherein said combination alto flute and piccolo peg includes a stem that is detachably connected to said support member and extends upwardly from said support member a distance sufficient to support a flute, and further including a smaller stem attached to the top end of said first mentioned stem for supporting a piccolo flute.

16. A stand as specified in claim 7 wherein said combination flute and piccolo peg includes a stem that is detachably connected to said support member and extends upwardly from said support member a distance sufficient to support a flute, and further including a smaller stem attached to the top end of said first mentioned stem for supporting a piccolo flute.

17. A stand as specified in claim 7 wherein each of said musical instrument pegs includes a stem that is detachably connected to said support member.

18. A stand as specified in claim 1 wherein said bearing means supports said support member at a location radially outward from the axis of rotation of said support member further than the radial distance from the axis to said instrument support pegs to facilitate stability of the stand.

19. A stand as specified in claim 1 wherein said base member is ring-shaped and said bearing means comprises a lazy Susan bearing.

20. A stand as specified in claim 19 wherein said support member is annular in shape, wherein each of said musical instrument pegs includes a stem that is detachably connected to said support member, said pegs being uniformly positioned on a circle midway between the inner and outer diameters of said support member, the center of said circle being coincident with the axis of rotation of said support member on said base member, wherein the stem associated with each of the pegs centers and holds the instrument to be supported thereby in proper position, the fit of the stem within the bore of the instrument being snug but adapted to easy removal of the instrument from the stem, and wherein at least some of the stems associated with said pegs include an inverted truncated cone at the base thereof and a bulb at the top thereof configured to conform to the shape of the bell and the bore of the instrument to be supported thereby.

21. A stand as specified in claim 1 wherein said base member and said support member each comprise a metal plate.

22. A stand as specified in claim 21 wherein each of said musical instrument pegs includes a stem that is detachably connected to said support member.

23. A stand as specified in claim 22 with said pegs being mounted on a circle having the axis of rotation of said support member on said base member at its center.

24. A stand as specified in claim 23 wherein the stem of each of said pegs comprises a threaded stud, said support member including a separate tapped hole for receiving one end of an associated one of said studs, each of said studs extending through a portion at least of the associated peg, and further including a resilient stopper at the other end of each of said studs, each of said stoppers having the shape of an inverted truncated cone and being selected in size to conform to the bore of the musical instrument to be supported by the associated peg.

25. A stand as specified in claim 1 further including luminescent tip means along the uppermost edges of each of said instrument support pegs to facilitate location thereof in dimly lit environments.

26. A stand as specified in claim 25 wherein said luminescent tips are fluorescent.

27. A rotatable musical instrument stand for woodwind instruments comprising:

(a) a base member;

(b) a rotatable support member;

(c) bearing means supporting said support member for rotation on said base member, and (d) a plurality of upwardly extending musical instrument support pegs mounted in spaced relation on the upper surface of said support member whereby access to any of the musical instruments mounted on said pegs is facilitated by rotation of said support member on said base member, each of said support pegs including a luminescent tip means along the uppermost edge thereof to facilitate location thereof in dimly lit enviroments.

28. A stand as defined in claim 27 wherein said luminescent tips are fluorescent.

* * * * *